US006892044B2

(12) United States Patent
Yasui et al.

(10) Patent No.: US 6,892,044 B2
(45) Date of Patent: May 10, 2005

(54) LIQUID APPLICATION APPARATUS AND IMAGE FORMATION APPARATUS

(75) Inventors: Motokazu Yasui, Tokyo (JP); Masanao Ehara, Tokyo (JP); Hideo Furukawa, Tokyo (JP); Masaaki Yoshikawa, Tokyo (JP); Hiroshi Yoshinaga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 10/170,440

(22) Filed: Jun. 14, 2002

(65) Prior Publication Data

US 2003/0007813 A1 Jan. 9, 2003

(30) Foreign Application Priority Data

Jun. 18, 2001 (JP) ..... 2001-182864

(51) Int. Cl.[7] ..... G03G 15/20
(52) U.S. Cl. ..... 399/324; 399/325
(58) Field of Search ..... 399/324, 325; 118/DIG. 1

(56) References Cited

U.S. PATENT DOCUMENTS

| | | | | | |
|---|---|---|---|---|---|
| 4,378,752 | A | * | 4/1983 | Knechtel | 399/325 |
| 4,593,992 | A | * | 6/1986 | Yoshinaga et al. | 399/321 |
| 4,942,433 | A | * | 7/1990 | Stuart | 399/325 |
| 5,132,739 | A | * | 7/1992 | Mauer et al. | 399/325 |
| 5,327,204 | A | * | 7/1994 | Sculley et al. | 399/325 |
| 5,481,350 | A | | 1/1996 | Yasui et al. | |
| 5,563,695 | A | * | 10/1996 | Sakurai et al. | 399/325 |
| 5,710,956 | A | * | 1/1998 | Kurohata et al. | |
| 5,729,798 | A | | 3/1998 | Yasui et al. | |
| 5,745,247 | A | | 4/1998 | Yasui et al. | |
| 5,749,036 | A | * | 5/1998 | Yoda et al. | 399/325 |
| 5,832,354 | A | | 11/1998 | Kouno et al. | |
| 5,915,147 | A | | 6/1999 | Kouno et al. | |
| 5,940,672 | A | * | 8/1999 | Kagawa | 399/325 |
| 6,219,520 | B1 | | 4/2001 | Ehara | |
| 6,263,182 | B1 | * | 7/2001 | Baker et al. | 399/325 |
| 6,449,457 | B2 | * | 9/2002 | Samei et al. | |

FOREIGN PATENT DOCUMENTS

| | | | | | |
|---|---|---|---|---|---|
| JP | 59-154479 | | | 9/1984 | |
| JP | 64-76085 | | | 3/1989 | |
| JP | 01-106086 | | | 4/1989 | |
| JP | 2-160274 | | | 6/1990 | |
| JP | 04181279 | A | * | 6/1992 | G03G/15/20 |
| JP | 05100596 | A | * | 4/1993 | G03G/15/20 |
| JP | 06-110351 | | | 4/1994 | |
| JP | 11/038812 | | | 2/1999 | |
| JP | 11/161076 | | | 6/1999 | |
| JP | 2000-89599 | | | 3/2000 | |
| JP | 2000-131988 | | | 5/2000 | |
| JP | 2001-42685 | | | 2/2001 | |

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A liquid application apparatus includes a target to which a liquid is to be applied and an application unit arranged to come in contact or get separated from the target and which applies the liquid to the target when in contact. The target performs cycle motion. A minimum time for which the application unit comes in contact with the target is equal to or greater than a period of the cycle motion of the target.

8 Claims, 3 Drawing Sheets

LIQUID APPLICATION APPARATUS AND IMAGE FORMATION APPARATUS

FIELD OF THE INVENTION

The present invention relates to a liquid application apparatus which applies a liquid such as silicon oil for preventing offset and an image formation apparatus which uses the liquid application apparatus. More specifically, the present invention relates to the prevention of nonuniform application of oil for preventing offset in an offset prevention oil application mechanism provided in a fixing device which is used for an image formation apparatus.

BACKGROUND OF THE INVENTION

An image formation apparatus such as a copier, a printer or a facsimile is provided with a fixing device which thermally fuses a toner image transferred onto a recording sheet and which fixes the toner image.

As one configuration of the fixing device, there is known a configuration which uses a heating roller system. This heating roller system is provided to combine a fixing roller including a heat source with a pressure roller which is opposite to the fixing roller and which can rotate to be interlocked with the fixing roller while being abutted on the fixing roller to thereby act heat and pressure on the toner image.

Since the heating roller system employs rollers having a relatively high heat capacity, it takes long time to raise the temperature of the rollers up to a predetermined fixing temperature. To replace this configuration, therefore, there is proposed a configuration in which a belt of a very low heat capacity is used. According to the latter configuration, the belt is laid on a pair of rollers, the pressure roller is arranged to face one of the rollers, a heat source is incorporated in the other roller and the belt is thereby heated. This configuration is advantageous not only in that the belt can be heated in shorter time and time required to raise the belt temperature up to a predetermined temperature can be shortened but also in that a part of the extended surface of the belt is put along the peripheral surface of the pressure roller, whereby the holding and conveying region or a so-called nip width of a recording paper which carries the toner image can be increased, a heating region for the toner image is increased and fixing efficiency can be, therefore, improved.

The fixing device is provided with a constituent element that prevents the inverted transfer or so-called offset of toner in a fused state to a member on a side in contact with the toner from occurring. As such a constituent element, there is known one that applies an offset prevention liquid which serves as a mold releasing agent.

To apply the offset prevention liquid, a felt, a part of which is soaked in a liquid of an offset prevention liquid tank, is employed, and the offset prevention liquid is pumped up from the tank using the surface tension of the felt.

The method of applying the offset prevention liquid pumped up using the felt has the following disadvantage. If the felt is kept in contact with a member to which the offset prevention liquid is supplied and to which the roller or the belt corresponds, i.e., a target to which a liquid is applied ("application target"), the pump-up action of the felt is continued and the offset prevention liquid becomes excessive on the surface of the application target, with the result that a part of the recording sheet which carries the toner image may possibly be damaged.

To overcome this disadvantage, a configuration in which the felt is brought into contact with the application target only when the offset prevention liquid on the application target is scant is conventionally proposed.

If the felt is provided in such a manner as to come in contact with and be separated from the target to which the offset prevention liquid is supplied, the amount of the off set prevention liquid impregnated into the felt sometimes changes by the evaporation of the offset prevention liquid depending on the amount of impregnated offset prevention liquid or a standby time required until the felt contacts with the application target. If the amount of the offset prevention liquid impregnated into the felt is large, in particular, the offset prevention liquid is excessively supplied to the felt compared with an instance in which the amount of the impregnated offset prevention liquid is small. As a result, when the felt contacts with the application target, the offset prevention liquid has been excessively supplied to the application target. If so, every time the felt contacts with the application target, then the offset prevention liquid is excessively applied to the member, the application target has sections to which the excessive offset prevention liquid is applied and those to which the offset prevention liquid is applied less excessively and the nonuniform application of the offset prevention liquid occur intermittently to the application target. This phenomenon causes the same result as that if the offset prevention liquid is transferred onto the sheet on which the toner image to be fixed is carried and spots are generated on the sheet. Consequently, a corrugation phenomenon occurs to the sheet, disadvantageously making the appearance of the sheet unfavorable.

SUMMARY OF THE INVENTION

It is an object of the present invention to provide a liquid application apparatus and an image formation apparatus which can eliminate the nonuniform application of an offset prevention liquid and prevent a recording sheet from being damaged.

The liquid application apparatus according to one aspect of this invention comprises a target to which a liquid is to be applied, and an application unit which is arranged to come in contact or get separated from the target and applies the liquid to the target when in contact. The target performs cycle motion, the application unit is formed of a felt which can be impregnated with the liquid, and a minimum time for which the application unit comes in contact with the target is equal to or greater than a period of the cycle motion of the target.

The image formation apparatus according to another aspect of this invention employs the liquid application apparatus according to this invention.

Other objects and features of this invention will become apparent from the following description with reference to the accompanying drawings.

DETAILED DESCRIPTION

Embodiment of the present invention will be explained hereinafter with reference to the accompanying drawings.

Figure 1:
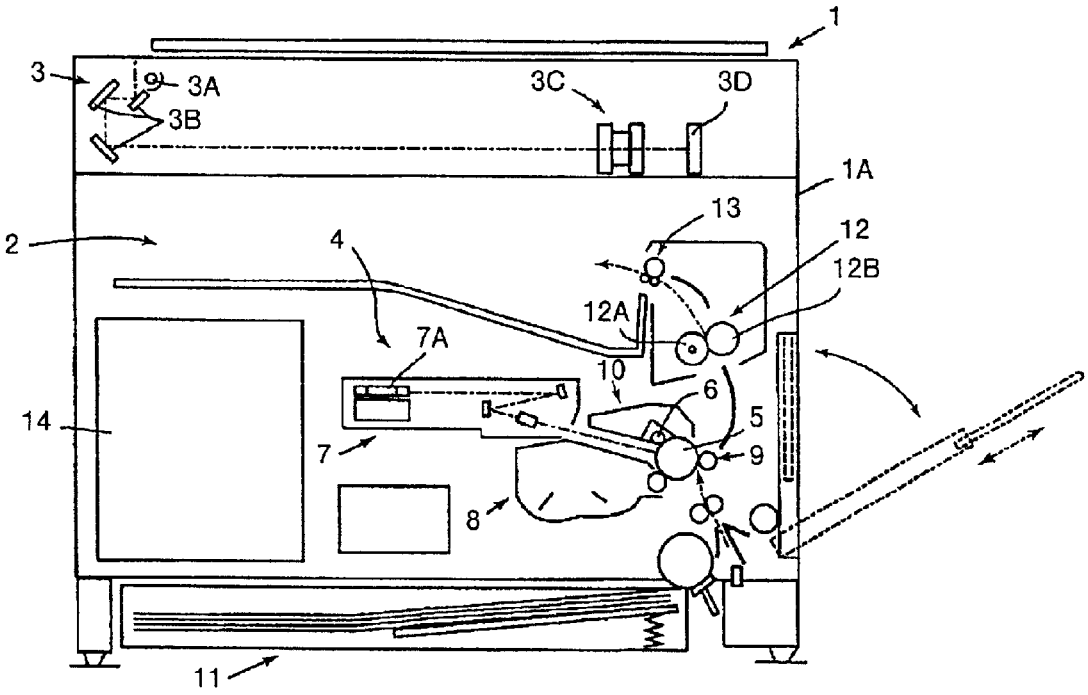
FIG. 1 is a schematic diagram for explaining the configuration of an image formation apparatus which employs a liquid application apparatus in one embodiment of the present invention.

FIG. 1 is a schematic diagram showing one example of an image formation apparatus to which a liquid application apparatus in one embodiment of the present invention is applied. The image formation apparatus 1 shown in FIG. 1 is of not such a type as to discharge a sheet to the outside of a housing but of an internal discharge type allowing sheets to be discharged within the housing.

The image formation apparatus 1 has a paper discharge section 2 which is provided in almost a central portion in the height direction of the housing 1A. An original read section 3 and an image formation section 4 to be explained later are provided in the upper section and the lower section of the paper discharge section 2, respectively.

In this embodiment, the image formation section 4 includes a photosensitive drum 5 which corresponds to a drum-like latent image carrier. The photosensitive drum 5 is rotated counterclockwise in the figure by a driving source, not shown.

A charge device 6, a write device 7, a developing device 8, a transfer device 9, and a cleaning device 10 used to execute an electrophotographic copying process are arranged around the photo sensitive drum 5 along the rotating direction. A paper feed device 11 is provided below the photosensitive drum 5. A fixing device 12 and a paper discharge device 13 are arranged on the downstream of the transfer device 9 and the upstream of the paper discharge section 2 in a paper feed direction indicated by a chain line.

A light source 3A and reflecting mirrors 3B for changing an optical path are provided to scan an original which is put on an original mount, reflected light from the original is incident on an optical element 3D such as a CCD via a read optical system 3C, and the incident light is output, as original image information, to a control section 14 by an optical component 3D.

The write device 7 is constituted to apply scanning light from a polygon mirror 7A onto the photosensitive drum 5 via a semiconductor laser, not shown, and a reflecting mirror and an image formation lens which constitute an image formation optical system, to thereby form an electrostatic latent image.

The paper feed section 11 is provided with a paper feed tray supply roller and a regist roller of well-known structure. In the image formation apparatus 1 shown in FIG. 1, one more switchable paper feed tray is provided on a part of the wall section of the image formation apparatus 1 as indicated by a two-dot chain line.

The light emission of the semiconductor laser is controlled based on an image signal from the control section 14. The control section 14 controls the driving of the semiconductor laser by the image signal according to not only the image information from the original read section 3 but also a printing signal if the apparatus 1 is employed as a printer or a transmission signal if the apparatus 1 is employed as a facsimile apparatus. Thus, the control section 14 enables the image formation apparatus 1 to have a property as a digital multifunction machine which functions as not only a copier but also a printer and a facsimile.

Figure 2:
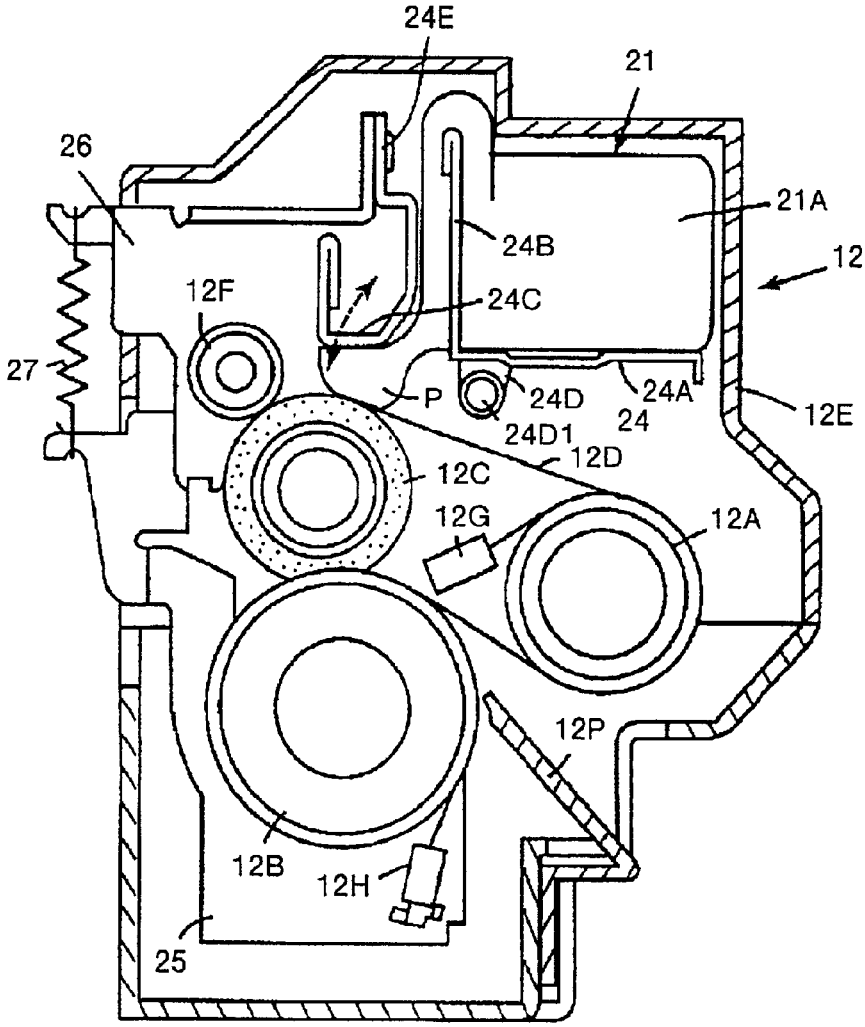
FIG. 2 is a cross-sectional view for explaining the configuration of the liquid application apparatus shown in FIG. 1.

As shown in FIG. 1, the fixing device 12 has a structure in which a heating roller 12A located on a side in contact with a toner image carried on a recording sheet such as a paper sheet supplied from the paper feed device 11 and a pressure roller 12B which is opposed to the heating roller 12A and which can be interlocked with the heating roller 12A, or has a structure, as shown in FIG. 2, in which a fixing belt 12D abutted on the heating roller 12A along the peripheral direction of the heating roller 12A. The heating roller 12A and the fixing belt 12D in the latter instance are the parts which differ in operation, i.e., the heating roller 12A performs a rotating operation and the fixing belt 12D performs a moving operation, but which can make a cycle movement in a cooperative manner.

The configuration of the fixing device 12 having the latter structure will be explained below.

The fixing device 12 shown in FIG. 2 is provided with the fixing belt 12D which is laid on the heating roller 12A including a heat source and on a fixing roller 12C opposed to and abutted on the pressure roller 12B. The fixing belt 12D can be moved in a direction in which the recording sheet can be conveyed, through the rotation of the fixing roller 12C located on a driving side.

The fixing belt 12D has an oil carrying layer which consists of a heat resistant resin layer or a rubber layer and which is provided on a surface layer thereof. A part of the fixing belt 12D is extended along the peripheral surface of the pressure roller 12B, whereby a nip width can be set large when the recording sheet is held and conveyed.

The recording sheet is conveyed toward a section on which the fixing belt 12D and the pressure roller 12B are abutted on each other, by a guide section 12P which is provided in the casing 12E of the fixing device 12. The recording sheet is conveyed while being held in the abutted section between the fixing belt 12D and the pressure roller 12B. By doing so, the toner image carried on the surface of the recording sheet is fixed by heat applied from the fixing belt 12D and the pressure applied from the section in which the recording sheet is held. As shown in FIG. 1, even if the heating roller 12A instead of the fixing belt 12D is brought into direct contact with the toner image carrying surface of the recording sheet, the surface layer of the heating roller 12A has the same configuration as that of the fixing belt 12D.

The fixing device 12 is provided with an application apparatus 21 which applies a mold releasing agent for offset prevention to the fixing belt 12D located on the side in contact with the toner image.

As the offset prevention mold releasing agent, a liquid such as silicon oil (to be referred to as "oil" hereinafter) is used. The oil is leached out and supplied from a liquid discharge section provided in the application apparatus 21 to be explained later. In this embodiment, therefore, the fixing belt 12D serves as an application target to which the oil is applied.

Figure 3:
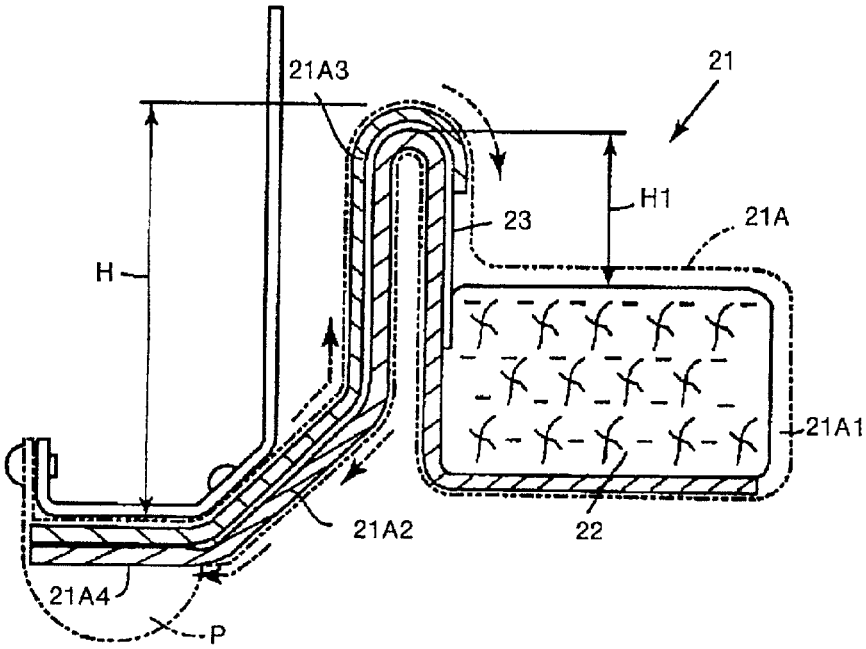
FIG. 3 is a cross-sectional view for explaining the principle configuration of a liquid supply unit used in the liquid application apparatus shown in FIG. 2.

FIG. 3 is a view for explaining the principle configuration of the application apparatus 21. In FIG. 3, the application apparatus 21 is provided with a bag member 21A, and is constituted to pump up the oil and to apply the oil to the fixing belt 12D which serves as the application target.

As shown in FIG. 3, the application apparatus 21 is provided with the bag member 21A which includes an enclosed space 21A1 into which a liquid or the oil used as the mold releasing agent in this embodiment is filled. The bag member 21A is constituted as an outer envelope material formed of a combination of a polyester film such as a PEN film (trademark of Teijin Ltd.) and an aramid felt nonwoven fabric as indicated by a two-dot chain line in FIG. 3.

The enclosed space 21A1 which can contain the oil therein is set to have a larger volume than that of the other sections of the bag member 21A so that the oil can be filled into the enclosed space 21A1.

The enclosed space 21A1 is filled with pad-like fiber 22 using cottons or the like which can be impregnated with a liquid. By impregnating the fiber 22 with the oil, the oil can be spread throughout the enclosed space 21A1 irrespectively of the tilt of the space 21A1. In this embodiment, polyester cottons are used as the fiber 22.

In the bag member 21A, a liquid supply section 21A2 and a liquid feedback section 21A3 are provided on the front and rear surfaces of the bag member 21A, respectively, to be isolated from each other except for some part thereof. Namely, the liquid supply section 21A2 and the liquid feedback section 21A3 are isolated from each other by a partition 23 a part of which contacts with the oil in the enclosed space 21A1. At the position of the partition 23 at which the partition 23 is out of contact with the oil, the liquid supply section 21A2 and the liquid feedback section 21A3 are brought into contact with each other.

The partition 23 is formed of a bendable plate-like shielding member made of a material which is incompatible with oil such as PET (polyethylene terephthalate) or PTFE (polytetrafluoroethylene). A part of the partition 23 contacts with the oil contained in the enclosed space 21A1 and is extended to a position at which the partition 23 is out of contact with the oil in the vicinity of the contact position between the liquid supply section 21A2 and the liquid feedback section 21A3. Therefore, at a position at which the partition 23 does not exist, the liquid supply section 21A2 and the liquid feed back section 21A3 are brought into contact with each other.

The liquid supply section 21A2 is formed of a bendable member made of a porous or fibrous material and having a contact angle (wetting angle) of not more than 90 degrees with respect to the oil corresponding to the liquid. Apart of the liquid supply section 21A2 is positioned to have such a height (H1) as to obtain a capillary rise action based on the contact angle (wetting angle). In this embodiment, an aramid felt, a ceramic paper or the like is used as the liquid supply section 21A2 and liquid feedback section 21A3, and an aramid felt, a connected bubble sponge or the like is used as the liquid feedback section 21A3.

The liquid feedback section 21A3 is provided in a state in which a part of the section 21A3 is integrated with the liquid supply section 21A2 while being contacted with the liquid supply section 21A2 and in which a part of the section 21A3 in the vicinity of the enclosed space 21A1 is kept out of contact with the oil contained in the enclosed space 21A1. That is, the liquid feedback section 21A3 on the enclosed space 21A1 side is cut out so as not to contact with the oil in the enclosed space 21A1, and this non-contact part is constituted as an oil dropping section.

The liquid feedback section 21A3 is constituted out of a porous or fibrous member which is made of a material having a contact angle of not more than 90 degrees with respect to the oil as in the instance of the liquid supply section 21A2 and which member is bendable to follow the bending deformation of the liquid supply section 21A2. As in the instance of the liquid supply section 21A2, a part of the liquid feedback section 21A3 is positioned to have such a height (H) as to obtain a capillary rise action based on the contact angle (wetting angle). The height (H) in this instance is measured based on a position, as a reference, at which the liquid feedback section 21A3 contacts with the liquid supply section 21A2.

A liquid discharge section 21A4 is provided at the position at which the liquid supply section 21A2 contacts with the liquid feedback section 21A3 on the side of the liquid supply section 21A2.

The liquid discharge section 21A4 is constituted out of a member which is formed by opening a part of the bag member 21A and to which it is necessary to apply oil, i.e., a section in contact with the fixing belt 12D shown in FIG. 2. The liquid discharge section 21A4 is provided to be bonded to a part of the liquid supply section 21A2. In this embodiment, the liquid discharge section 21A4 is formed of a nonwoven fabric which is made of a mixture of aramid and PET and which can be impregnated with oil. The material of such a nonwoven fabric is set according to the property of any member requiring oil application. If the member is required to have heat resistance, for example, the above material is used. The properties including this heat resistance are set in the liquid supply section 21A2 and the liquid feedback section 21A3 as well.

The liquid discharge section 21A4 can leach out the oil and transfer the oil to the fixing belt 12D which is an application target. It is also possible to attach a member which can set the amount of oil supplied to the fixing belt 12D and which contacts with the fixing belt 12D at a different position from that of the bag member 21A. That is, in order to define the amount of oil to be leached out as indicated by a two-dot chain line in FIG. 3, a pad-like liquid application member (denoted by a reference symbol P in FIG. 3) in which volume and density are preset so that the amount of oil to be applied, i.e., the amount of oil to be transferred is obtained, can be bonded integrally to the surface of the nonwoven fabric made of the mixture material.

In the fixing device 12 shown in FIG. 2, an oil application pad (denoted by the same reference symbol P as that used in FIG. 3 for the convenience sake) which serves as a liquid application member integral with the liquid discharge section 21A4 is swollen out toward the fixing belt 12D at a position in contact with the fixing belt 12D.

The liquid supply section 21A2 and the liquid feedback section 21A3 are set to have the following relationship.

If the liquid discharge section 21A4 does not supply oil to the fixing belt 12D, i.e., the oil leached out from the liquid discharge section 21A4 is not consumed, then the amount of the oil which moves through the liquid supply section 21A2 and reaches the liquid discharge section 21A4 is set equal to the amount of the oil which is pumped up by the liquid feedback section 21A3 in contact with the liquid supply section 21A2 in the contact section therebetween and which reaches the enclosed space 21A1. The relationship is set for the following reason. If the oil is not consumed while the fixing belt 12D does not operate and the oil moving through the liquid supply section 21A2 is continuously transferred to the fixing belt 12D, then the oil carried on the fixing belt 12D becomes excessive, disadvantageously causing a trouble such as the damage of the fixing belt 12D or that of the image surface of the recording sheet which contacts with the fixing belt 12D. The relationship is set to prevent such a trouble from occurring. To this end, the fibrous member which constitutes the liquid supply section 21A2 is differentiated in density from that of the liquid feedback section 21A3. By doing so, the oil is prevented from being leached out excessively from the liquid discharge section 21A4. The configuration of the application apparatus 21 as explained above is disclosed in detail in Japanese Patent Application Laid-Open No. 2001-38265 according to the prior application filed by the applicant of the present application.

The fixing device 12 shown in FIG. 2 has a configuration to obtain the capillary rise action of the liquid supply section 21A2 provided in the application apparatus 21.

The support section of the application apparatus 21 in the fixing device 12 is provided with a support unit 24 which consists of a base section 24A, which mounts thereon a side of the bag member 21A where the enclosed space 21A1 positions, a pump-up setting section 24B, which is formed by protruding a part of the base section 24A upward and which has a protrusion height set at such a height as to allow the liquid supply section 21A2 to exhibit its capillary rise action, and a discharge section positioning section 24C, which abuts the liquid discharge section 21A4 on the surface of the fixing belt 12D.

In this embodiment, the support unit 24 is located above the extended position of the fixing belt 12D. Therefore, the support unit 24 has a bracket 24D which is supported by the casing 12E of the fixing device 12 and a discharge section side bracket 24E above the extended position of the fixing belt 12D. Each of the brackets is supported by the casing 12E of the fixing device 12 by fastening or the like.

The liquid discharge section 21A4 is located below the enclosed space 21A1 of the bag member 21A because of the arrangement of the support unit 24 above the extended position of the fixing belt 12D. As shown in FIG. 3, therefore, the liquid discharge section 21A4 is oriented from the position of the height where the capillary rise action of the liquid supply section 21A2 is obtain to the downward direction. The position of the discharge section positioning section 24C can be thus adjusted to the direction in which the liquid discharge section 21A4 contacts with the surface of the fixing belt 12D so that the contact relationship between the liquid discharge section 21A4 in the liquid supply section 21A2 bent downward at the pump-up setting section 24B and the fixing belt 12D can be optimized. That is, the discharge section side bracket 24E is integrated with the liquid discharge section 21A4 on one surface, but at a position at which the bracket 24E is fixed to the casing 12E, the fixing of the bracket 24E to the liquid discharge section 21A4 is loosened, whereby the other surface of the bracket 24E can be moved.

Besides the above constituent elements, the fixing device 12 is provided with a cleaning roller, as denoted by a reference symbol 12F in FIG. 2, which contacts with the surface of the fixing belt 12D and which scrapes away excessive oil, and temperature detection units, such as thermistors, which detect the surface temperatures of the fixing belt 12D and the pressure roller 12B as denoted by reference symbols 12G and 12H, respectively.

The temperature detection units 12G and 12H detect the surface temperatures of the fixing belt 12D and the pressure roller 12B and can output signals to the control section 14 (see FIG. 1), respectively. The control section 14 optimizes the fixing temperature and detects abnormality.

In FIG. 2, the pressure roller 12B and the fixing roller 12C opposed to and abutted on the pressure roller 12B are supported by rotation axis support members 25 and 26 provided independently of each other, respectively. The rotation axis support members 25 and 26 are urged in a direction in which the members 25 and 26 approach each other by an elastic member 27 such as a spring which is engaged with parts of the members 25 and 26. As a result, the fixing belt 12D stretched around the fixing roller 12C is urged toward the pressure roller 12B to thereby make it possible to keep the nip width between the belt 12D and the pressure roller 12B.

The bracket 24D of the support unit 24 can be rocked through a spindle 24D1 inserted into the bracket 24D at this position in a direction in which the oil application pad (member denoted by the symbol P in FIG. 2) provided on the discharge section positioning section 24C can contact with and separate from the fixing belt 12D, as indicated by an arrow. Therefore, the spindle 24D1 of the bracket 24D corresponds to the rocking fulcrum of the application apparatus 21 provided with the oil application pad P. By rocking the bracket 24D, the oil application pad P contacts with and separates from the fixing belt P12D. To allow this rocking operation, the support structure of the discharge side bracket 24E is made deformable while being interlocked with the rocking of the oil application pad P is provided. Alternatively, the support structure of the discharge side bracket 24E is made a structure in which a section of the liquid supply section 21A2 at which the oil application pad P is located and the liquid feedback section 21A3 on the side of the oil application pad P are pressed against the discharge side bracket 24E while the discharge side bracket 24E is left unmoved to thereby separate the oil application pad P from the surface of the fixing belt 12D.

The rocking operation of the support unit 24 is carried out by a rocking drive unit, not shown, using, for example, a rotary solenoid or the like integrated with the spindle 24D1. The operating mode of the rocking drive unit is set by the control section 14.

Figure 4:
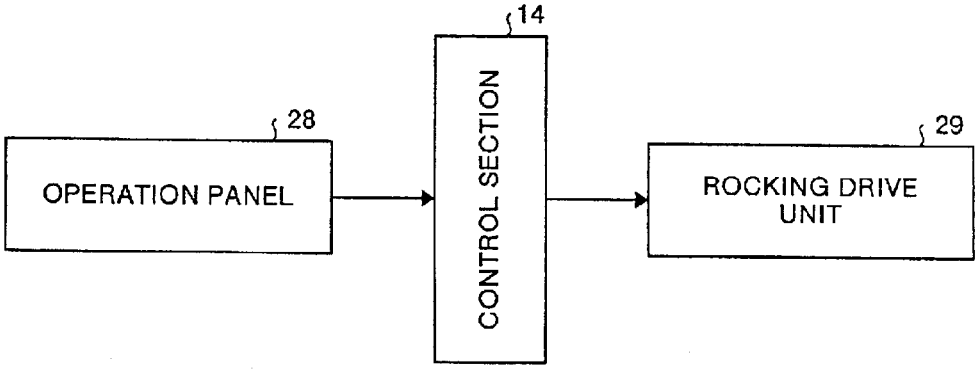
FIG. 4 is a block diagram for explaining the configuration of a control section which controls the contact state of the liquid supply unit shown in FIG. 3.

FIG. 4 is a block diagram which explains the configuration of the key sections of the control section 14. In FIG. 4, the control section 14 includes, as a principal section, a microcomputer which can maintain and control the temperatures explained above. An operation panel 28 is connected to the input side of the control section 14 via an I/O interface, not shown, and a rocking drive unit 29 which specifies the rotation amount of the spindle 24D1 is connected to the output side thereof.

The operation panel 28 is a part through which an image formation mode and the number of times of image formation are input. The number of times of image formation corresponding to, for example, the number of sheets to be copied is used to set a feed interval of recording sheets and to count time from the time at which the use of the oil application pad (P) is started. Namely, the control section 14 calculates a starting time of feeding a recording sheet, a standby time for the oil application pad (P) and an elapsed time from when the oil application pad (P) is started to be used which means that the oil application pad (P) is brand-new, based on the number of times of image formation set in the operation panel 28, and sets a time at which the oil application pad (P) starts contacting with the fixing belt 12D and a contact time.

The contact start time for the oil application pad (P) set by the control section 14 corresponds to time for which no recording sheet is fed. The minimum contact time during that time is based on the following criteria:

(1) The minimum contact time is not less than time required for one cycle motion of the fixing belt 12D serving as the application target or the heating roller 12A. As for the fixing belt 12D, one cycle motion means the movement of the belt 12D by which an arbitrary position circulates around and returns to an original position. As for the heating roller 12A, one cycle motion means the rotation of the roller 12A by which an arbitrary position in the peripheral direction circulates around and returns to an original position.

(2) The minimum contact time is set longer as the time from when the oil application pad (P) serving as an application unit is started to be used is shorter.

(3) The minimum contact time is set longer as the standby time of the oil application pad (P) is longer.

The conditions (1) and (2) are set in view of an instance in which the capillary phenomenon accelerates pumping up the oil and are set in order to even an oil application distribution on the surface of the fixing belt 12D even if portions with the oil excessively applied are produced on the surface of the fixing belt 12D by the acceleration of the pump-up of the oil.

Since the image formation apparatus in this embodiment is constituted as explained above, oil is pumped up from the liquid supply section 21A1 toward the liquid discharge section 21A4 and the oil is supplied from the liquid discharge section 21A4 to the oil application pad P in the liquid application unit 21. It is, therefore, possible to prevent the shortage of oil and to efficiently prevent offset.

The oil application pad P in the liquid application unit 21 contacts with the fixing belt 12D to thereby apply the oil to the fixing belt 12D, and separates from the fixing belt 12D to thereby stop applying the oil to the fixing belt 12D.

The contact of the oil application pad P with the fixing belt 12D is started at the time at which no recording sheet is fed to the fixing nip section, and the contact time is based on the conditions (1) and (2) above.

According to this embodiment, at the time at which no recording sheet is fed, the contact state of the oil application pad P is made correspond to at least one cycle motion of the fixing belt 12D or the motion time of not less than one rotation of the heating roller 12A. Therefore, even if excessive oil is somewhat applied to the fixing belt 12D at the time at which the oil application pad P contacts with the fixing belt 12D, the oil applied by the oil application pad P in contact with the fixing belt 12D (if the fixing device 12 is constituted as shown in FIG. 2) or the heating roller 12A (if the fixing device 12 is constituted as shown in FIG. 1) is equalized by the time at which one cycle motion ends. As a result, the portions to which the oil is excessively applied are eliminated and the nonuniform application of the oil on the surface of the fixing belt 12D or that of the heating roller 12A is eliminated. Besides, the applied oil equalization operation is carried out for the time for which the recording sheet does not contact with the fixing belt 12D or the recording sheet does not contact with the heating roller 12A. Therefore, even if excessively applied portions are produced on the surface, the excessive oil is not transferred to the recording sheet, making it possible to prevent spot-like nonuniformity in oil on the recording sheet.

According to this embodiment, the time for which the oil application pad P contacts with the heating roller 12A (if the fixing device 12 is constituted as shown in FIG. 1) or with the fixing belt 12D (if the fixing device 12 is constituted as shown in FIG. 2) is set according to a state in which the oil is pumped up. Therefore, even if excessive oil is applied to the heating roller 12A or the fixing belt 12D by pumping up the oil, it is possible to equalize the oil applied states on the applied surface thereof and to eliminate the nonuniform application irrespectively of the oil pump-up state.

According to the present invention, the minimum time for which the application unit comes in contact with the application target is set to be equal to or greater than a period of the cycle motion of the target. The liquid is thereby equalized on the entire periphery of the application target and portions to which the liquid is excessively deposited can be eliminated. It is, therefore, possible to eliminate nonuniform application on the entire periphery of the application target to obtain a uniform application state.

Moreover, the minimum time can be set according to a change in the amount of the liquid impregnated into the application unit. It is, therefore, possible to stabilize the amount of the applied liquid and to prevent excessively applied portions from occurring. According to the invention, it is possible to prevent occurrence of any portion with excessively applied oil because the liquid is equalized on the surface of the application target even if the case as follows occurs. That is, the capillary phenomenon accelerates pumping up the liquid as seen in a brand-new product. The consumption of the liquid due to re-contact of the application unit with the application target causes the liquid to be suddenly pumped up, which easily enters into a state in which the liquid is excessively applied during the standby time.

Furthermore, the application unit applies the liquid to the fixing member, which is used as the application target, for the minimum time when the fixing member does not perform a fixing operation. It is, therefore, possible to eliminate the nonuniform application on the surface of the fixing member and then to contact the fixing member with the sheet. Thus, it is possible to prevent the nonuniformly applied liquid on the surface of the fixing member from being transferred onto the sheet and to prevent spot-like nonuniformity in liquid from occurring to the sheet.

Moreover, the time at which the application unit is started to come in contact with the fixing member, is set by the control section which can control the sheet conveying state. It is, therefore, possible to contact the sheet with the fixing member after the state of liquid application is stabilized on the surface of the fixing member. It is there by possible to prevent the nonuniformly applied liquid on the surface of the fixing member from being transferred onto the sheet.

Furthermore, the nonuniformly applied liquid on the application target by the application unit can be eliminated. It is, therefore, possible to eliminate the transfer of the nonuniformly applied liquid onto the member, such as a sheet, which contacts with the application target and to prevent the member which contacts with the application target from being damaged by the transfer of the portions with excessively applied liquid to the member.

The present document incorporates by reference the entire contents of Japanese priority document, 2001-182864 filed in Japan on Jun. 18, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A liquid application apparatus comprising:

a target to which a liquid is to be applied, the target making cycle motion; and an application unit which is arranged to come in contact and get separated from the target and to apply the liquid to the target when in contact, the application unit formed of a felt which can be impregnated with the liquid, wherein a minimum time for which the application unit is arranged to come in contact with the target is equal to or greater than a period of the cycle motion of the target, and the minimum time is set based on a time elapsed from an initial use to a current use of the target.

2. The liquid application apparatus according to claim 1, wherein the minimum time is set longer as the elapsed time is shorter.

3. The liquid application apparatus according to claim 1, wherein a fixing member which can thermally fix toner is employed as the target, and the liquid is applied to the fixing member by the application unit for the minimum time when a fixing operation is not performed on a sheet which carries the toner.

4. The liquid application apparatus according to claim 3, wherein a time at which the application unit is started to come in contact with the fixing member, is set by a control unit which can control a conveying state of the sheet.

5. An image formation apparatus comprising a liquid application apparatus, the liquid application apparatus comprising:

a target configured to receive a liquid, the target configured to make a cyclical motion; and an application unit configured to come in contact and get separated from the target and to apply the liquid to the target when in contact, wherein a minimum time for which the application unit is arranged to come in contact with the target is equal to or greater than a period of the cycle motion of the target, and the minimum time is set based on a time elapsed from an initial use to a current use of the target.

6. A liquid application apparatus comprising:

a target rotatable on an axis;

an application unit positionable in a first orientation to contact the target and to apply a liquid to the target and a second orientation to separate from the target, the application unit comprising:

a control section adapted to position the application unit in the first orientation for a time period that is greater than or equal to a period of rotation of the target, wherein the time period is set based on a time elapsed from an initial use to a current use of the target.

7. The liquid application apparatus according to claim 6, wherein the target comprises a fixing member.

8. The liquid application apparatus according to claim 7, wherein the fixing member comprises a fixing belt.

* * * * *